US007642964B2

(12) United States Patent
DiNallo et al.

(10) Patent No.: US 7,642,964 B2
(45) Date of Patent: Jan. 5, 2010

(54) LOW PROFILE INTERNAL ANTENNA

(75) Inventors: Carlo DiNallo, Plantation, FL (US); Antonio Faraone, Fort Lauderdale, FL (US)

(73) Assignee: Motorola, Inc., Schaumburg, IL (US)

( * ) Notice: Subject to any disclaimer, the term of this patent is extended or adjusted under 35 U.S.C. 154(b) by 29 days.

(21) Appl. No.: 11/553,845

(22) Filed: Oct. 27, 2006

(65) Prior Publication Data

US 2008/0100516 A1 May 1, 2008

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 4,625,212 | A | 11/1986 | Oda et al. | |
| 4,862,181 | A | 8/1989 | Ponce de Leon et al. | |
| 4,955,084 | A | 9/1990 | Umetsu | |
| 5,300,937 | A | 4/1994 | Capp et al. | |
| 5,861,854 | A * | 1/1999 | Kawahata et al. | 343/702 |
| 5,940,041 | A | 8/1999 | Koyama et al. | |
| 6,177,908 | B1 * | 1/2001 | Kawahata et al. | 343/700 MS |
| 6,195,048 | B1 | 2/2001 | Chiba et al. | |
| 6,762,723 | B2 | 7/2004 | Di Nallo et al. | |
| 6,762,763 | B1 | 7/2004 | Migdal et al. | |
| 6,950,072 | B2 * | 9/2005 | Miyata et al. | 343/702 |
| 7,136,020 | B2 * | 11/2006 | Yamaki | 343/702 |
| 7,196,667 | B2 * | 3/2007 | Watada et al. | 343/700 MS |
| 7,339,528 | B2 * | 3/2008 | Wang et al. | 343/700 MS |
| 7,423,598 | B2 * | 9/2008 | Bit-Babik et al. | 343/702 |
| 2004/0090373 | A1 | 5/2004 | Faraone et al. | |
| 2004/0169606 | A1 * | 9/2004 | Sato et al. | 343/702 |
| 2004/0252063 | A1 * | 12/2004 | Sadamori et al. | 343/702 |
| 2005/0024271 | A1 | 2/2005 | Ying et al. | |
| 2006/0244665 | A1 | 11/2006 | Tung | |
| 2007/0085747 | A1 * | 4/2007 | DiNallo et al. | 343/702 |

FOREIGN PATENT DOCUMENTS

| | | |
|---|---|---|
| GB | 2366916 | 3/2002 |
| WO | WO 2008/063788 | 5/2008 |

* cited by examiner

*Primary Examiner*—Tan Ho
(74) *Attorney, Agent, or Firm*—Philip H. Burrus, IV

(57) ABSTRACT

A multi-band folded inverted conformal antenna (101), suitable for use internally within an electronic device (501), facilitates low-profile designs with the multi-band folded inverted conformal antenna (601) extending less than five millimeters above a circuit substrate (102) in some embodiments. The multi-band folded inverted conformal antenna (601) includes planar sections and a slot (407), and is capable of multi-mode operation. For example, one embodiment is configured to operate in a first common mode (401), a differential mode (402), and a second common mode (403), thereby allowing the multi-band folded inverted conformal antenna (601) to operate in a first operational bandwidth, second operational bandwidth, and third operational bandwidth. Portions of the ground plane conductor (103) passing beneath the multi-band folded inverted conformal antenna (101) are selectively removed at areas corresponding to concentrations of electrical charge, thereby allowing a more low-profile design.

20 Claims, 5 Drawing Sheets

FIG. 8
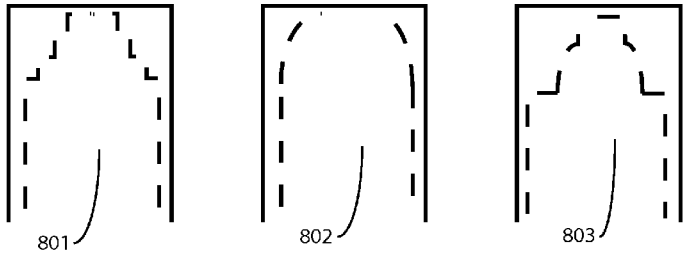
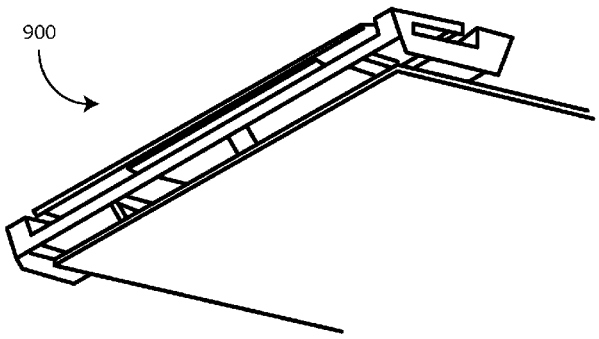
FIG. 9
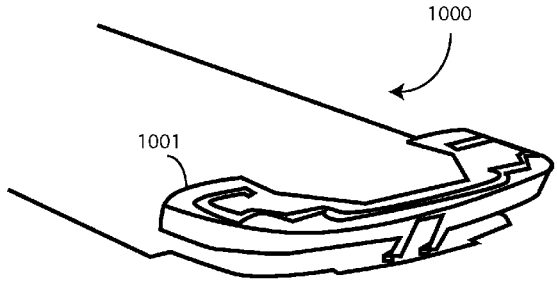
FIG. 10

LOW PROFILE INTERNAL ANTENNA

BACKGROUND

1. Technical Field

This invention relates generally to antennas for communication devices, and more particularly to a low profile, multi-band antenna suitable for internal use within a communication device.

2. Background Art

Electronic devices are continually evolving. For example, at one time a mobile telephone was a relatively large device with a long, floppy, protruding antenna. Due to advances in technology, modem mobile telephones are slimmer and lighter. As mobile telephones have gotten smaller in size, so too have the antennas they employ. Antenna design has advanced to the point that some modem mobile telephones do not include protruding antennas at all. They rather rely upon internal antenna structures for communication with cellular towers and base stations. The use of internal antennas has allowed designers and engineers to create sleeker and more fashionable products.

One popular antenna in use today is the planar inverted-F antenna (PIFA). This antenna is widely available and well suited to dual-band operation. "Dual-band" means that the antenna has two resonance frequency bands, and is suitable for communicating in two primary bandwidths. For example, a dual-band planar inverted-F antenna may be used in a dual-band GSM phone operating in both GSM 900 (880 MHz-960 MHz) and GSM 1800 (1710 MHz-1880 MHz) bands. The dual-band planar inverted-F antenna splits in two branches, where the longer branch resonates (thereby producing electromagnetic radiation) in one band, while the shorter branch resonates in another band.

The problems with this type of antenna are two fold: First, they are difficult to design for tri-band operation. For example, a phone required to operate in GSM 900, GSM 1800, and UMTS (1920 MHz-2170 MHz) would not function well in every bandwith, especially given the typical size and volume limitations of modem mobile telephones, if the phone employed a planar inverted-F antenna.

Second, the different branches of the planar inverted-F antenna essentially compete with each other to claim a portion of a given available physical volume in the mobile telephone. The effect of this competition is that each resonant mode has associated therewith a higher Q than it would have if the whole physical volume was provided to each branch. This means that each resonant band becomes narrower, and thus less effective. Thus, there is a limit to the amount the planar inverted-F antenna structure may be reduced in size without affecting performance. In short, to function properly, dual-band planar inverted-F antennas are relatively large. This is a problem for designers who continually want to make mobile communication devices smaller and thinner.

There is thus a need for an improved antenna that functions in multiple bandwidths, yet is more compact in size, which achieves suitable radiated efficiency levels.

BRIEF DESCRIPTION OF THE DRAWINGS

FIG. 8 illustrates alternative ground plane structures in accordance with embodiments of the invention.

FIG. 9 illustrates an embodiment of an antenna having alternative ground plane voids in accordance with embodiments of the invention.

FIG. 10 illustrates an embodiment of an antenna in accordance with the invention that includes curved antenna structure surfaces.

Figure 1:
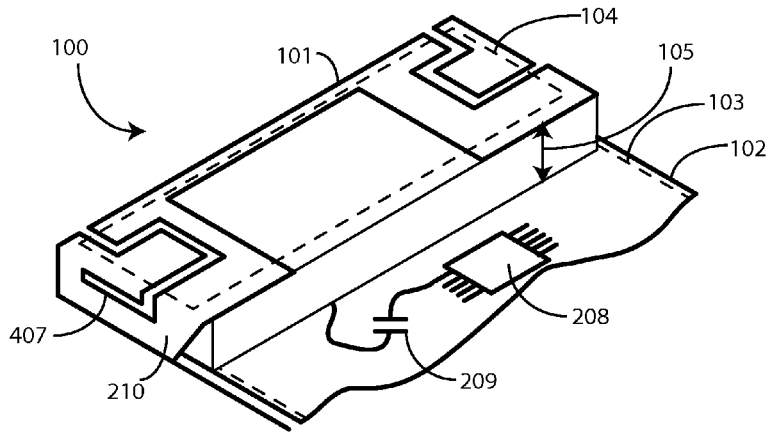
FIGS. 1 and 2 illustrate views of one embodiment of a multi-band folded inverted conformal antenna in accordance with the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Illustrated and described herein is an improved multi-band folded inverted conformal antenna for use in communication devices. The multi-band folded inverted conformal antenna is capable of operation in three frequency bands, and is suitable for internal use in a mobile communication device. The antenna is capable of performing in extremely thin configurations, with the antenna to circuit board height capable of being reduced below five millimeters, which is nearly half the height of that typically required by planar inverted-F antennas to achieve similar spectrum coverage in electronic devices such as mobile phones.

In one embodiment, this low profile performance is achieved by selectively removing the ground plane from the printed circuit board upon which the antenna is mounted. By removing portions of the ground plane beneath concentrated electric field locations, the effective antenna volume is increased, thereby lowering the Q and increasing the fractional bandwidth of each resonance mode, thus improving performance. The removal of selective ground sections corresponding to large E-field concentrations allows the overall thickness of the structure to be reduced without sacrificing performance.

While a conventional dual-band planar inverted-F antenna uses only a portion of the volume defined by the antenna and circuit board in each resonance band, the multi-band folded inverted conformal antenna of the present invention takes advantage of the entire volume in all three of its resonance modes. In one embodiment, the multi-band folded inverted conformal antenna is an elongated conductor that is generally symmetrical with respect to the circuit board upon which it is mounted. Additionally, one embodiment of the invention employs a U-shaped design, thereby allowing for the placement of components beneath, and next to, the antenna element.

Figure 2:
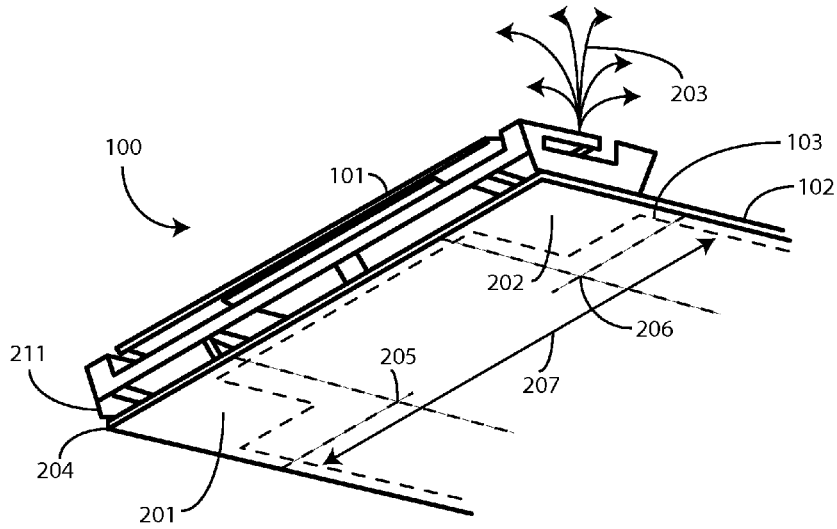

Turning now to FIGS. 1 and 2, illustrated therein is one embodiment of a low-profile antenna assembly 100 in accordance with the invention. The antenna assembly includes a multi-band folded inverted conformal antenna element 101, which is manufactured from an electrically conductive material such as copper or aluminum. The multi-band folded inverted conformal antenna element 101 is coupled to a circuit substrate 102 that includes a ground structure 103. The antenna element 101 and the ground structure 103 work in tandem to form the overall antenna structure.

The circuit substrate 102, in one embodiment, is a printed wiring board made from layered FR4 fiberglass. Between some of these layers copper is disposed. For example, in one embodiment the ground plane conductor 103 is made by disposing a layer of copper or other electrically conducting material between layers of the FR4 fiberglass. While a printed wiring board is one example of a suitable circuit substrate, it will be clear to those of ordinary skill in the art having the benefit of this disclosure that the invention is not so limited. Other substrate materials, including flexible substrates made by disposing layers of copper between Kapton® or other materials may be equally used to support a ground structure 103 serving as part of the antenna assembly 100. Additionally, the ground structure 103 need not be a single contiguous structure. Suitable ground structures may be constructed from multiple inter-coupled layers or inter-coupled sections as well.

The ground plane conductor 103 is selectively removed to improve the performance of the low-profile antenna assembly 100. For instance, in one embodiment, the ground plane conductor 103 includes one or more ground plane voids 201, 202 disposed at locations corresponding to relatively high electrical field densities 203 associated with concentrations of electric charges induced on the antenna element 101. The inclusion of the ground plane voids 201, 202 where the strongest concentrations of electrical charge are disposed along the multi-band folded inverted conformal antenna element 101 allows the effective volume of the low-profile antenna assembly to expand.

Ground plane voids, as shown herein, refer to removal of the ground plane structure. However, note that "effective" ground plane voids may also be obtained by making an antenna assembly overhang the circuit board as is shown in the embodiment 900 of FIG. 9.

In one embodiment, the multi-band folded inverted conformal antenna element 101 includes a planar portion 104 (identified by the dotted rectangle in FIG. 1), which is disposed substantially parallel with the circuit substrate 102 and the portion of ground structure 103 embedded therein. The planar portion 104 is separated from the circuit substrate 102 by an antenna height 105. By including the ground plane voids 201, 202, this antenna height 105 can be reduced below five millimeters. Experimental testing has shown effective tri-band performance with an antenna height of between three and five millimeters.

The multi-band folded inverted conformal antenna element 101 is well suited as an internal antenna in a communication device such as a mobile telephone. Loading of the antenna by the hand or other objects can be reduced by disposing the multi-band folded inverted conformal antenna element 101 at the end of the circuit substrate 102. In one embodiment, the circuit substrate 102 includes a distal end 204, and the multi-band folded inverted conformal antenna 101 is disposed at the distal end 204. The distal end 204 includes corner regions 205, 206 located at the corners of the circuit substrate 102. Where the multi-band folded inverted conformal antenna 101 is disposed at the distal end 204, the ground plane voids 201, 202 may be located in the corner regions 205, 206, as these regions correspond to high E-field concentrations along the multi-band folded inverted conformal antenna element 101.

To provide some relative perspective, assume that the circuit substrate 102 is defined by a circuit substrate width 207. Depending upon the design of the multi-band folded inverted conformal antenna element 101, which will be described in more detail below, the corner regions 205, 206 and corresponding ground plane voids 201, 202 may have a width that is less than 25% of the circuit substrate width 207. Where the ground plane conductor 103 is removed in these corner regions 205, 206, the ground plane conductor 103 at the distal end 204 of the circuit substrate 102 resembles the shape of the letter "T" in cross section.

It will be clear to those of ordinary skill in the art that the ground plane conductor 103 need not be a perfect T. As used herein, the T-shape refers to all variations where the ground plane conductor 103 is reduced in width at the distal end 204 when compared to the circuit substrate width 207. For instance, the ground plane conductor 103 could be stair-stepped, gradually reducing in width the ground plane conductor. Such geometry is suitable for certain applications in accordance with embodiments of the invention. The ground plane voids 201, 202 may also have a curved shape, even expanding or tapering as they pass about the edge of the circuit substrate. Some exemplary embodiments 801, 802, 803 are illustrated in FIG. 8.

As noted above, the multi-band folded inverted conformal antenna element 101, working in combination with the ground structure 103, is capable of serving as a tri-mode antenna 100 with a first operational bandwidth, second operational bandwidth, and third operational bandwidth. This tri-mode functionality is due at least in part to the geometric structure of the multi-band folded inverted conformal antenna element 101. In one embodiment, the multi-band folded inverted conformal antenna element 101 includes a folded structure operating in each of a first common mode, a differential, and a second common mode.

Figure 3:
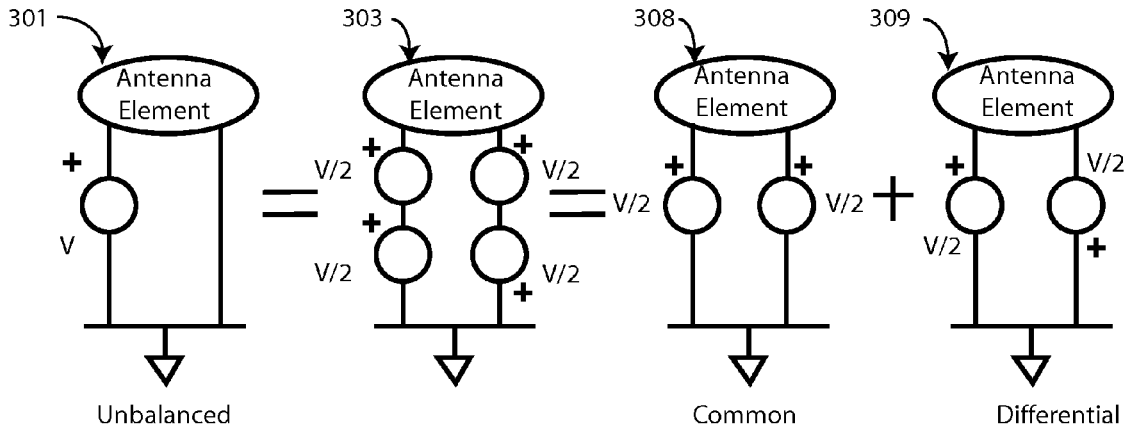
FIGS. 3 and 4 illustrate operational modes of one embodiment of a multi-band folded inverted conformal antenna in accordance with the invention.
Figure 4:
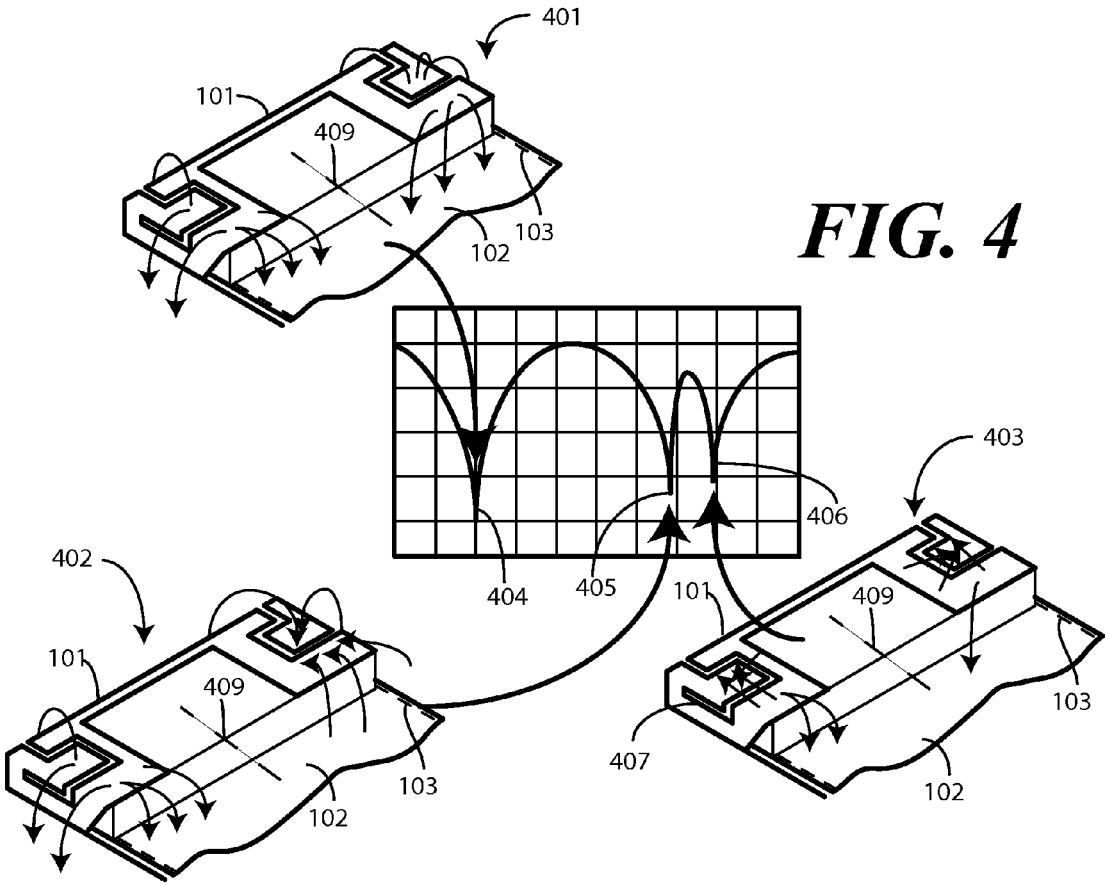

Turning briefly to FIGS. 3 and 4, illustrated therein are the first common, differential, and second common modes in operation. When the multi-band folded inverted conformal antenna 101 is driven by an unbalanced feeding structure, the driver or feeding structure is capable of exciting both even and odd (or common and differential) current configurations, thereby enabling multi-mode operation.

Multi-mode operation is best explained by way of superposition. Circuits 301, 303, and circuit 308 plus circuit 309 are all equivalents of each other. The circuits of FIG. 3 illustrate that an unbalanced circuit 301 is equivalent to the superposition of a common-mode circuit 308 and a differential mode circuit 309.

FIG. 4 provides a graphical idea of the E-field lines associated with the first common mode operation 401, differential mode operation 402, and second common mode operation 403. Each mode of operation has a corresponding resonance 404, 405, 406 and operational bandwidth. Note that the resonances 404, 405, 406 are not necessarily in the order displayed in FIG. 4. For example, while the second common mode 403 is shown as having the highest center frequency 406, different geometric structures may result in the modes being arranged in a different order.

In first common mode operation 401, the E-field lines extend between the multi-band folded inverted conformal antenna element 101 and the ground plane conductor 103 in the circuit substrate 102. In the first common mode, the E-fields are substantially symmetric with respect to a centerline 409 splitting the circuit substrate longitudinally.

In differential mode operation 402, the E-field is substantially anti-symmetric. At a given moment in time, on one side of centerline 409 of antenna assembly 100, the E-field prevalently points toward the ground structure 103, while the E-field prevalently points towards the multi-band folded inverted conformal antenna element 101 on the other side of the center line 409. In second common mode operation 403, the E-field lines are strongly concentrated and pass across the slot 407, and distributed substantially symmetrically with respect to centerline 409. As the E-field lines cross the slot, this second common mode of operation is sometimes colloquially referred to as a "slot mode" of operation.

The three modes of operation, first common mode 401, differential mode 402, and second common mode 403, correspond to different operational frequency bands that are used to support different communication channels. These communication channels may be used with different communication protocols. By employing the ground plane conductor voids (201, 202) of the present invention, the E-fields associated with the multi-band folded inverted conformal antenna 101 may occupy a larger volume around the antenna element 101, thereby reducing the intensity of reactive electromagnetic energy trapped in the antenna and producing a lower Q-factor. The result is a correspondingly larger fractional bandwidth, for each resonance mode. The ground plane conductor voids (201,202) allow the field to expand where the strongest concentrations of charge, and thus the strongest E-fields exist.

Turning now back to FIGS. 1 and 2, one reason that strong charge concentrations and E-fields exist in the vicinity of the ground plane conductor voids 201, 202 is the slot 407. In one embodiment, the multi-band folded inverted conformal antenna element 101 includes a side portion 210 extending distally from the circuit substrate 102. The slot 407 passes along at least a section of this side portion. Not only does the geometry of the slot allow for better tuning of the multi-band folded inverted conformal antenna element 101, but it also helps to cause electric charge accumulation to occur over the ground plane conductor voids 201, 202, thereby maximizing the desired reactive energy density reduction effect.

The side portions 210, 211 form a first and third face, and are joined by the planar portion 104, which serves as the first face. Transitions, such as the bends in the multi-band folded inverted conformal antenna element 101, in one embodiment, occur above the ground plane conductor voids 201, 202. In one embodiment, the planar portion 104, which may be substantially parallel with the circuit substrate 102, is substantially "U" shaped. The U-shape allows components to be placed on the circuit substrate 102 in the middle of the U, thereby increasing the usable area of the circuit substrate 102. Note, however, that other shapes, in addition to the U-shape, may also be employed. For example, a reverse-U shape may also be used. When the reverse-U is employed, the ground plane voids on the corners still provide a beneficial aspect in allowing the E-fields to extend over a larger volume.

Note also that the faces of the antenna structure need not be flat. Turning briefly to FIG. 10, illustrated therein is an antenna 1000 having a curved face 1001. The curved face 1001 still serves as a "planar portion" as the term is used herein. The antenna 1000 shown in FIG. 10, featuring a curvilinear perimeter of the multi-band folded inverted conformal antenna element footprint, as well as other differently shaped equivalents, is particularly well suited for devices having curved mechanical housings.

Turning now back to FIGS. 1 and 2, a transceiver circuit 208 is used to drive the multi-band folded inverted conformal antenna 101. In one embodiment, the transceiver circuit 208 is capacitively coupled to the multi-band folded inverted conformal antenna 101 by a serial capacitor 209. The feed and ground connections to the multi-band folded inverted conformal antenna element 101 are relatively electrically short and may produce an inductive behavior of the antenna response. Tuning may be achieved by using the serial capacitor 209 to provide the correct phase rotation associated with signals delivered to antenna assembly 100.

Figure 5:
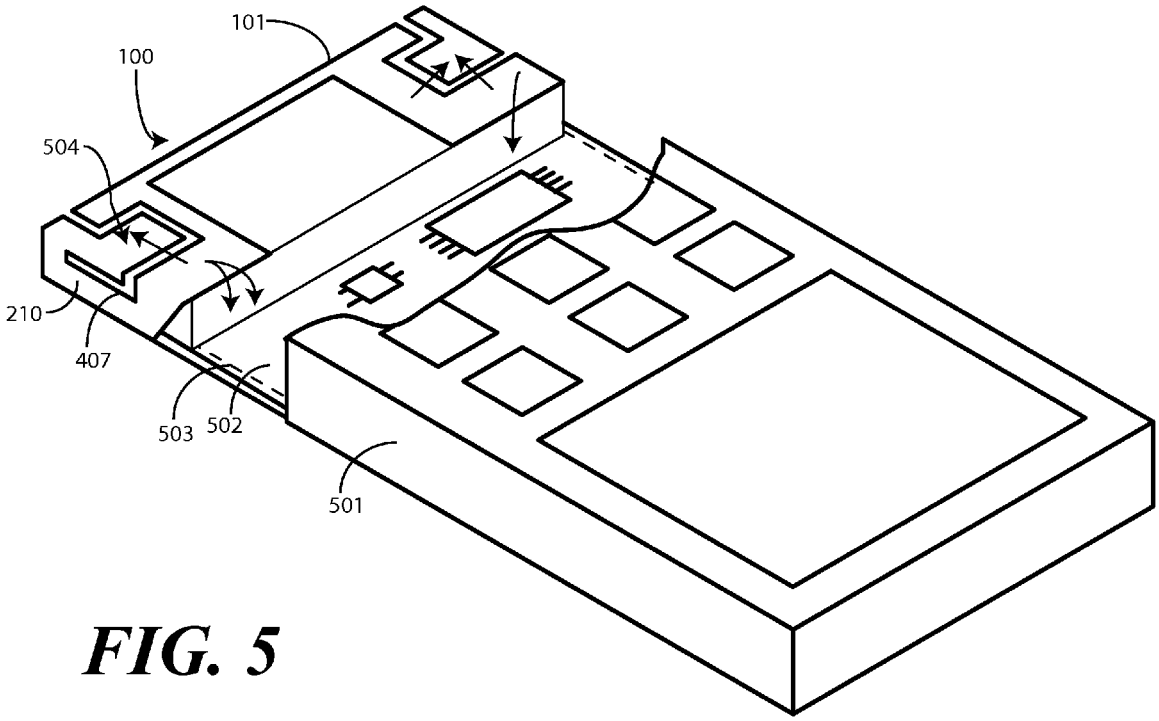
FIG. 5 illustrates an electronic device employing a multi-band folded inverted conformal antenna in accordance with one embodiment of the invention.

Turning now to FIG. 5, illustrated therein is one embodiment of a two-way communication device 501 comprising a multi-band folded inverted conformal antenna element 101 in accordance with the invention. The multi-band folded inverted conformal antenna element 101 is coupled to a printed circuit board 502 having a ground plane 503. As with the embodiments of FIGS. 1 and 2, portions of the ground plane 503 beneath the multi-band folded inverted conformal antenna 101 are removed at locations corresponding to strong electric field configurations associated with the multi-band folded inverted conformal antenna element 101 operating within an operational bandwidth. For example, where the multi-band folded inverted conformal antenna element 101 includes a slot 407 terminating on a side portion 210 of the multi-band folded inverted conformal antenna element 101 extending distally from the printed circuit board 502, portions of the ground plane may be removed at corners of the printed circuit board 502, under the corner regions 504 of the multi-band folded inverted conformal antenna element 101.

Thus, as with previously described embodiments, where the printed circuit board 502 includes an end with corner regions, and the multi-band folded inverted conformal antenna element 101 is disposed at the end as shown in FIG. 5, the portions of the ground plane that are removed may be at the corners of the printed circuit board 502. Thus, the antenna element 101 is able to be reduced in height, as the removed ground plane portions permit the antenna assembly 100 to radiate more efficiently. To provide exemplary dimensions to give a relative scope of scale, in a typical mobile telephone, a printed circuit board 502 within the device may be 30 mm to 75 mm in width. Where the corner portions of the ground plane are removed, the removed ground plane portions may measure 20 millimeters or less in width. This distance corresponds to approximately $1/15^{th}$ of the longest resonant wavelength of the antenna assembly.

Figure 6:
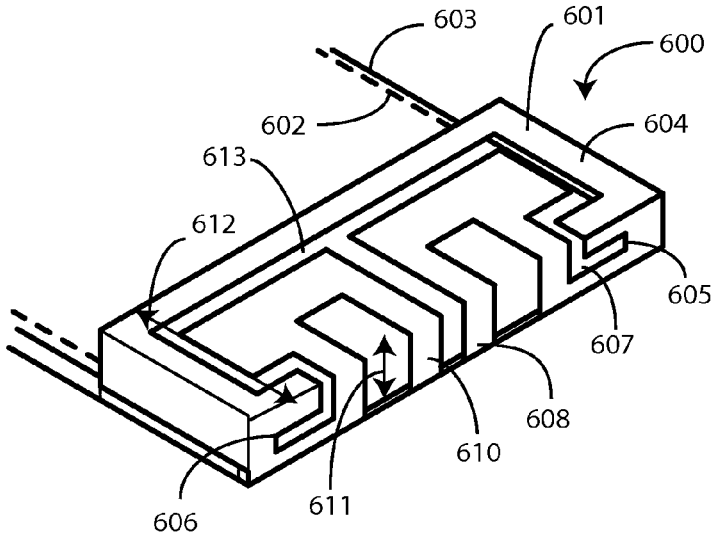
FIGS. 6 and 7 illustrate views of one embodiment of a multi-band folded inverted conformal antenna in accordance with the invention.
Figure 7:
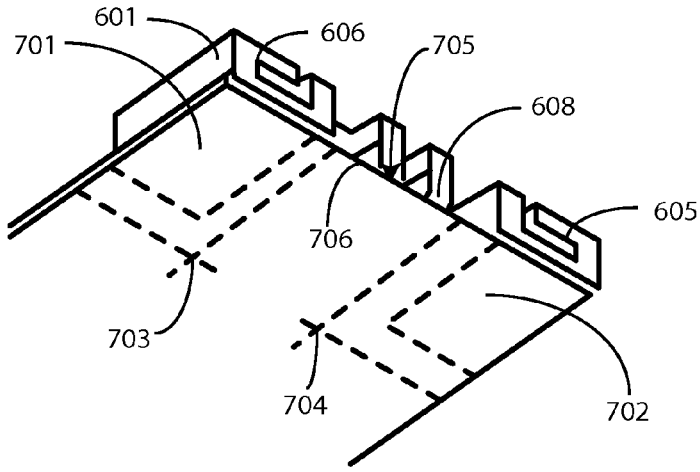

Turning now to FIGS. 6 and 7, illustrated therein is an alternate embodiment of an antenna assembly 600 having essentially a "T-shaped structure folded back on ground." This alternate structure is configured to also operate as a multi-band folded inverted conformal antenna element 601 in accordance with the invention. Rather than having a slot passing along a U-shape, the alternate multi-band folded inverted conformal antenna 601 includes a central slot 607 a top slot section 613 that passes across the top of the structure. The alternate multi-band folded inverted conformal antenna element includes one ground point 608, and one signal feed at point 705.

The alternate multi-band folded inverted conformal antenna element 601 is coupled to a printed circuit board 603 having a ground structure 602 coupled thereto. A signal is fed into point 705, traverses and excites the antenna element 601, and couples to the ground plane at point 608. Working in conjunction with the ground structure 602, the alternate multi-band folded inverted conformal antenna element 601 and ground structure 602 offer tri-mode operation. As with other embodiments of the invention, the ground plane 602 is selectively removed to improve the overall performance of the antenna assembly 600 when manufactured in a thin form factor.

Specifically, in one embodiment, the ground plane 602 includes ground plane voids 701, 702 disposed beneath portions of the alternate multi-band folded inverted conformal antenna element 601. In one embodiment, these ground plane voids 701, 702 are disposed at corners of the printed circuit board 603. Note that other embodiments of the invention may include ground plane voids near the edge 706 of the printed circuit board below the antenna element 601.

In one embodiment the alternate multi-band folded inverted conformal antenna element 601 includes a first side 610 extending distally from the printed circuit board 603. A second side 604 extends substantially orthogonally from the first side 610. It will be clear to those of ordinary skill in the art having the benefit of this disclosure that the sides need not be orthogonal. Where, for example, the application or geometric structure of the electronic device allows, improved or equal performance may be achieved when the sides are non-orthogonal between each other and with the circuit board. Some embodiments of the invention employ a first side extending distally from the printed circuit board at acute or obtuse angles.

A slot 607 traverses the first side 610 and second side 604, and includes termination points 605, 606 on the first side 610 near corner regions 703, 704 of the printed circuit board 603. By terminating the slot 607 on the first side 610, and removing portions of the ground plane 602 at the corner regions 703, 704, the height 611 of the overall antenna assembly 600 may be reduced without affecting performance. Simulation and testing has shown that the second side 604 may be less than five millimeters from the printed circuit board 603. A further advantage of the embodiment of FIGS. 6 and 7 is that the second side length 612 may be reduced. For instance, in one embodiment of the invention, the second side length 612 is less than 15 millimeters, while the antenna assembly 600 continues to operate effectively in three operational bandwidths.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention.

What is claimed is:

1. A low-profile antenna assembly, comprising:

a. a multiband folded inverted conformal antenna element; and b. a circuit substrate coupled to the multiband folded inverted conformal antenna element, the circuit substrate comprising a ground plane structure;

wherein the ground plane structure comprises at least two ground plane voids disposed at locations corresponding to electric charge concentrations associated with the multiband folded inverted conformal antenna.

2. The low-profile antenna assembly of claim 1, wherein the multiband folded inverted conformal antenna element comprises a planar portion separated from the circuit substrate by an antenna height, wherein the antenna height is less than five millimeters.

3. The low-profile antenna assembly of claim 1, wherein the circuit substrate comprises a printed circuit board having a distal end comprising at least two corner regions, wherein the multiband folded inverted conformal antenna element is disposed at the distal end.

4. The low-profile antenna assembly of claim 3, wherein the at least two ground plane voids are disposed at least at the at least two corner regions.

5. The low-profile antenna assembly of claim 4, wherein the circuit substrate comprises a circuit substrate width, wherein a corner region width of the at least two corner regions is less than twenty-five percent of the circuit substrate width.

6. The low-profile antenna assembly of claim 3, wherein the at least two ground plane voids are disposed along an edge of the printed circuit board.

7. The low-profile antenna assembly of claim 3, wherein the ground plane conductor at the distal end comprises a T-shaped cross-section.

8. The low-profile antenna assembly of claim 1, wherein the multiband folded inverted conformal antenna element is configured to operate in at least a first common mode, a differential mode, and a second common mode.

9. The low-profile antenna assembly of claim 1, wherein the multiband folded inverted conformal antenna element produces a tri-mode electromagnetic response having at least a first operational bandwidth, a second operational bandwidth, and a third operational bandwidth.

10. The low-profile antenna assembly of claim 9, wherein an electric charge associated with the multiband folded inverted conformal antenna when operating in one of the first operational bandwidth, the second operational bandwidth, or the third operational bandwidth is maximized at locations corresponding to the at least two ground plane voids.

11. The low-profile antenna assembly of claim 1, further comprising a transceiver circuit coupled to the multiband folded inverted conformal antenna, wherein the transceiver circuit is capacitively coupled to the multiband folded inverted conformal antenna.

12. The low-profile antenna assembly of claim 1, wherein the multiband folded inverted conformal antenna element comprises at least one side portion extending distally from the circuit substrate, further wherein the multiband folded inverted conformal antenna element comprises at least one slot.

13. The low-profile antenna assembly of claim 12, wherein at least a portion of the slot passes along the at least one side portion.

14. The low-profile antenna assembly of claim 12, wherein the multiband folded inverted conformal antenna further comprises a planar portion extending from the at least one side portion such that the planar portion is substantially parallel with the circuit substrate, wherein the planar portion is substantially U-shaped.

15. The low-profile antenna assembly of claim 1, wherein the multiband folded inverted conformal antenna element comprises a conductor having at least a first face, a second face, and a third face, wherein the second face couples the first face to the third face, wherein transitions from the first face to the second face and from the second face to the third face occur above the at least two ground plane voids.

16. A two-way communication device, comprising an internal folded inverted conformal antenna element coupled to a printed circuit board having a ground plane, wherein portions of the ground plane disposed beneath radiating elements of the internal folded inverted conformal antenna element are removed at locations corresponding to an electric charge configuration associated with the internal folded inverted conformal antenna element operating within an operational bandwidth.

17. The two-way communication device of claim 16, wherein the printed circuit board has an end comprising corner regions, wherein the internal folded inverted conformal antenna element is coupled to the printed circuit board at the end, wherein the portions of the removed ground plane are located in the corner regions.

18. The two-way communication device of claim 17, wherein the corner regions comprise a corner region length and a corner region width, wherein both the corner region length and the corner region width are less than $1/15^{th}$ of the longest resonant wavelength of the internal folded inverted conformal antenna element.

19. An antenna assembly, comprising a T-shaped conformal antenna folded back on ground coupled to a printed circuit board having a ground plane coupled thereto, wherein the T-shaped conformal antenna folded back on ground is electrically coupled to the ground plane at a single point, wherein the ground plane comprises ground plane voids disposed beneath at least portions of the T-shaped conformal antenna folded back on ground.

20. The antenna assembly of claim 19, wherein the T-shaped conformal antenna folded back on ground comprises a first side extending distally from the printed circuit board and a second side extending substantially orthogonally from the first side, wherein the T-shaped conformal antenna folded back on ground comprises a slot traversing at least the first side and the second side.

* * * * *